US010646986B2

(12) United States Patent
Teranishi et al.

(10) Patent No.: US 10,646,986 B2
(45) Date of Patent: May 12, 2020

(54) IMPACT TOOL

(71) Applicant: MAX CO., LTD., Tokyo (JP)

(72) Inventors: Akira Teranishi, Tokyo (JP); Kazunobu Yoshimura, Tokyo (JP); Kouichirou Morimura, Tokyo (JP)

(73) Assignee: MAX CO., LTD., Tokyo (JP)

( * ) Notice: Subject to any disclaimer, the term of this patent is extended or adjusted under 35 U.S.C. 154(b) by 580 days.

(21) Appl. No.: 15/177,614

(22) Filed: Jun. 9, 2016

(65) Prior Publication Data

US 2016/0361809 A1 Dec. 15, 2016

(30) Foreign Application Priority Data

Jun. 12, 2015 (JP) ..... 2015-119101

(51) Int. Cl.
*B25D 17/04* (2006.01)
*B25D 11/00* (2006.01)
*B25D 17/24* (2006.01)

(52) U.S. Cl.
CPC ..... *B25D 17/043* (2013.01); *B25D 11/00* (2013.01); *B25D 17/04* (2013.01); *B25D 17/24* (2013.01); *B25D 2211/006* (2013.01); *B25D 2250/051* (2013.01); *B25D 2250/245* (2013.01)

(58) Field of Classification Search
CPC ..... B25D 17/043; B25D 17/04; B25D 17/24; B25D 17/11; B25D 2250/371; B25D 2250/051; B25D 2250/245; B25D 2211/006; B25D 11/00; B25F 5/006
USPC ..... 173/162.2, 162.1, 179, 217, 109, 210
See application file for complete search history.

(56) References Cited

U.S. PATENT DOCUMENTS 5,697,456 A * 12/1997 Radle ..... B25D 17/043 173/162.2
6,766,868 B2 * 7/2004 Frauhammer ..... B25D 16/006 173/162.2
7,137,542 B2 * 11/2006 Oki ..... B25D 17/043 173/162.2

(Continued)

FOREIGN PATENT DOCUMENTS

DE 20122607 U1 7/2006
DE 102007043917 4/2009

(Continued)

OTHER PUBLICATIONS

Search Report dated Oct. 18, 2016 for European Patent Application No. 16001309.0.

*Primary Examiner* — Thanh K Truong
*Assistant Examiner* — Daniel Jeremy Leeds
(74) *Attorney, Agent, or Firm* — Rothwell, Figg, Ernst & Manbeck, P.C.

(57) ABSTRACT

An impact tool includes a mechanism part, a main-body housing and a grip housing. The mechanism part strikes a tool bit. The main-body housing holds the mechanism part therein. The grip housing is continuously provided to a rear portion of the main-body housing. One end portion of the grip housing is displaceably connected to the main-body housing through an elastic member, and the other end portion of the grip housing is rotatably connected to the main-body housing through a rotary joint. A center of the rotary joint is disposed on a leading end side of the impact tool with respect to a center of the elastic member, when viewed in a strike direction of the impact tool.

11 Claims, 6 Drawing Sheets

(56) References Cited

U.S. PATENT DOCUMENTS 7,500,527 B2 * 3/2009 Fischer ..... B25D 17/043 173/162.2
7,523,790 B2 * 4/2009 Arakawa ..... B25D 17/043 173/162.1
7,886,838 B2 * 2/2011 Hahn ..... B25D 17/043 16/110.1
8,091,651 B2 * 1/2012 Kuhnle ..... B25D 17/04 173/162.1
8,286,724 B2 * 10/2012 Furusawa ..... B25D 11/10 173/47
8,403,076 B2 * 3/2013 Iwakami ..... B25D 17/043 173/162.1
8,505,647 B2 * 8/2013 Kasuya ..... B25D 11/005 173/11
9,038,745 B2 * 5/2015 Mattson ..... B25B 21/00 173/216
9,505,118 B2 * 11/2016 Furusawa ..... B25D 17/043
9,782,885 B2 * 10/2017 Yoshikane ..... B25D 17/04
2006/0185867 A1 * 8/2006 Frauhammer ..... B25D 17/043 173/162.1
2006/0219418 A1 10/2006 Arakawa et al.
2008/0047724 A1 * 2/2008 Fischer ..... B25D 17/043 173/162.2
2008/0210447 A1 * 9/2008 Robieu ..... B25D 17/043 173/29
2008/0210451 A1 9/2008 Aoki
2009/0236111 A1 9/2009 Hahn
2009/0236112 A1 * 9/2009 Hahn ..... B25D 17/043 173/162.2
2010/0012339 A1 * 1/2010 Hahn ..... B25D 17/043 173/162.2
2010/0018734 A1 * 1/2010 Frauhammer ..... B25D 16/006 173/171
2010/0223760 A1 * 9/2010 Henke ..... B25F 5/006 16/431
2012/0067605 A1 * 3/2012 Furusawa ..... B25D 17/043 173/162.2
2013/0043052 A1 * 2/2013 Harcar ..... B25D 17/043 173/162.2
2014/0027253 A1 * 1/2014 Braun ..... B25D 17/00 200/61.58 R
2014/0318821 A1 * 10/2014 Wyler ..... B25D 11/125 173/104
2014/0352994 A1 * 12/2014 Yoshikane ..... B25D 17/04 173/162.2
2015/0202764 A1 * 7/2015 Roberts ..... B25D 17/24 173/162.2
2016/0207188 A1 * 7/2016 Weber ..... B25D 17/043
2017/0144287 A1 * 5/2017 Fischer ..... B25D 17/043

FOREIGN PATENT DOCUMENTS

EP 2 103 392 A1 9/2009
EP 2127820 A1 12/2009
EP 3103592 A1 * 12/2016 ..... B25D 17/043
JP S5063675 U 6/1975
JP 08-216046 A 8/1996
JP 2006-272511 A1 10/2006
JP 2008-188733 A 8/2008
JP 4461046 B2 5/2010

* cited by examiner

IMPACT TOOL

CROSS-REFERENCE TO RELATED APPLICATION

This application is based on and claims priority under 35 USC 119 from Japanese Patent Application No. 2015-119101 filed on Jun. 12, 2015.

TECHNICAL FIELD

The present invention relates to an impact tool that causes a striking operation by reciprocating a tool bit and, more particularly, to an impact tool with a mechanism intended to damp an impact force that is generated during a striking operation.

BACKGROUND

When an impact tool such as an electric hammer or an electric drill is used, the reaction of a striking operation is transmitted through a grip to a user. Thus, this may give vibration fatigue to the user or may cause joint disorder.

Therefore, there has been proposed a method in which a mechanism for reducing vibration generated during the striking operation is provided on the impact tool to damp an impact force that is generated during the striking operation.

For example, JP-B-4461046 discloses a structure in which a grip part is relatively rotatably joined to a main body of a working tool through a rotating shaft at one end side in an extending direction of the working tool, and is joined thereto through an elastic body and a vibration damping part at the other end side in the extending direction thereof. With such a structure, the grip part relatively rotates to perform a vibration absorbing action and simultaneously absorb a displacement difference by the elastic body. Further, it is believed that the absorbing action by the elastic deformation of the elastic body and the damping action of the vibration damping part may effectively reduce vibration.

SUMMARY

This kind of impact tool is located at a position where a center thereof is out of an axial direction of a tool bit. Therefore, when the tool bit is pushed back by the reaction force of a striking operation, the reaction force pushing the tool bit back does not act as it is but acts as a force for rotating the impact tool around the center of gravity.

However, the above-described structure according to the related art does not consider the absorption of force for rotating the impact tool, so that it is difficult to sufficiently damp an impact force. That is, as the force for rotating the impact tool is generated, force acts in the axial direction of the tool bit as well as in a direction perpendicular to the axial direction of the tool bit (the extending direction of the grip). However, the above-described structure according to the related art focuses on absorbing the force that acts in the axial direction of the tool bit, but does not consider the absorption of the force acting in the direction perpendicular to the axial direction of the tool bit (the extending direction of the grip). Therefore, when the force acts in the extending direction of the grip, there is no means for absorbing the force, with the result that it is difficult to sufficiently damp the impact force generated during the striking operation.

Accordingly, the invention is to provide an impact tool capable of reducing an impact force generated in an axial direction of a tool bit as well as an impact force generated in a direction perpendicular to the axial direction of the tool bit (the extending direction of the grip).

The invention has been made to solve the above-described problem, and is characterized as follows.

(1) According to one aspect of the invention, an impact tool includes a mechanism part, a main-body housing and a grip housing. The mechanism part strikes a tool bit. The main-body housing holds the mechanism part therein. The grip housing is continuously provided to a rear portion of the main-body housing. One end portion of the grip housing is displaceably connected to the main-body housing through an elastic member, and the other end portion of the grip housing is rotatably connected to the main-body housing through a rotary joint. A center of the rotary joint is disposed on a leading end side of the impact tool with respect to a center of the elastic member, when viewed in a strike direction of the impact tool.

(2) According to another aspect of the invention, an impact tool includes a mechanism part, a main-body housing and a grip housing. The mechanism part strikes a tool bit. The main-body housing holds the mechanism part therein. The grip housing is continuously provided to a rear portion of the main-body housing. One end portion of the grip housing is displaceably connected to the main-body housing through an elastic member, and the other end portion of the grip housing is rotatably connected to the main-body housing through a rotary joint. A center of the rotary joint is disposed on a leading end side of the impact tool with respect to a center of a motor which operates the mechanism part, when viewed in a strike direction of the impact tool.

(3) In the impact tool according to (1) or (2), when a spring constant of the elastic member is K, a striking frequency of the impact tool is f, and a mass of the grip is m, the spring constant of the elastic member is set to satisfy the following equation: $K<m\ (2\pi f)^2$.

(4) In the impact tool according to (1) or (2), the impact tool further includes a trigger. The trigger operates the mechanism part. The trigger is located to overlap with a center of gravity of the impact tool when projected in the strike direction of the impact tool.

(5) In the impact tool according to (1) or (2), the impact tool further includes a spring holding member. The spring holding member supports the elastic member between the main-body housing and the grip housing.

(6) In the impact tool according to (1) or (2), the impact tool further includes a pin. The pin is configured to pass through a hole of a pin engaging part of the main-body housing so as to be supported by the grip housing.

According to the first aspect of the invention described above, the grip housing is displaceably connected at one end thereof through the elastic member to the main-body housing, and rotatably connected at the other end thereof through the rotary joint to the main-body housing, and the center of the rotary joint is arranged to be closer to the leading end side of the tool bit (which is the leading side of the impact tool) than to the center of the elastic member when viewed in the axial direction of the tool bit (which is a strike direction of the impact tool). That is, the center of the rotary joint is located to be proximity to the mechanism part, so that the rotary joint is arranged to be closer to the center of gravity of the impact tool. Such a configuration makes it difficult to apply force in a direction (an extending direction of a grip) perpendicular to the axial direction of the tool bit on the rotary joint even when force for rotating the impact tool is applied. That is, when a striking operation is performed, the impact tool is intended to rotate about the center of gravity. However, when viewed in the axial direction of the tool bit, the center of the rotary joint is arranged to be closer to the center of gravity of the impact tool, so that it is difficult to act force in the extending direction of the grip on the rotary joint. In other words, a force component in the axial direction of the tool bit mainly acts on the rotary joint. Such a force may be sufficiently absorbed by the elastic member. Such an action makes it possible to reduce impact force generated in the axial direction of the tool bit as well as impact force generated in the direction (the extending direction of the grip) perpendicular to the axial direction of the tool bit.

According to the second aspect of the invention described above, the grip housing is displaceably connected at one end thereof through the elastic member to the main-body housing, and rotatably connected at the other end thereof through the rotary joint to the main-body housing, and the center of the rotary joint is arranged to be closer to the leading end side of the tool bit (which is the leading side of the impact tool) than to the center of the motor for operating the mechanism part when viewed in the axial direction of the tool bit (which is a strike direction of the impact tool). Similarly to the first aspect of the invention, this is configured such that the center of the rotary joint is arranged to be proximity to the mechanism part, so that the rotary joint is located at a position closer to the center of gravity of the impact tool and consequently it is possible to obtain the same effect as the first aspect of the invention.

According to the third aspect of the invention described above, when the spring constant of the elastic member is K, the striking frequency of the impact tool is f, and the mass of the grip is m, the spring constant of the elastic member is set to satisfy the following equation: $K<m\ (2\pi f)^2$. Such a configuration may obtain stable vibration controlling effects in consideration of vibration damping characteristics.

According to the fourth aspect of the invention described above, the impact tool further includes the trigger that operates the mechanism part, the trigger being located to overlap with the center of gravity of the impact tool when projected in the axial direction of the tool bit. Such a configuration makes it difficult for the tool bit to vibrate in an axial direction relative to a worker's hand having the trigger even when force acts to rotate the impact tool. That is, when a striking operation is performed, the impact tool is intended to rotate about the center of gravity. However, since the trigger is located to overlap with the center of gravity of the impact tool when viewed in the axial direction of the tool bit, so that it is difficult to act the axial force of the tool bit around the trigger. In other words, since a force component in an extending direction of a grip mainly acts around the trigger, it is possible to reduce a burden on a worker's arm holding the grip.

DETAILED DESCRIPTION

An embodiment of the invention will be described with reference to the accompanying drawings.

An impact tool 10 according to the present embodiment is a tool that causes a striking operation by reciprocating a tool bit. A tool bit attaching part 10*a* to which a tool bit (not illustrated) such as a drill bit or a bull point is detachably attached is formed on a leading end portion of the impact tool 10. After the tool bit is attached to the tool bit attaching part 10*a*, the tool bit is pushed against an object such as concrete or stone. Then, the impact tool 10 is driven to perform a drilling operation or a crushing operation by the tool bit.

Although an electric drill will be described by way of example in the present embodiment, the invention may use different kinds of impact tools such as an electric hammer without being limited thereto.

Figure 1:
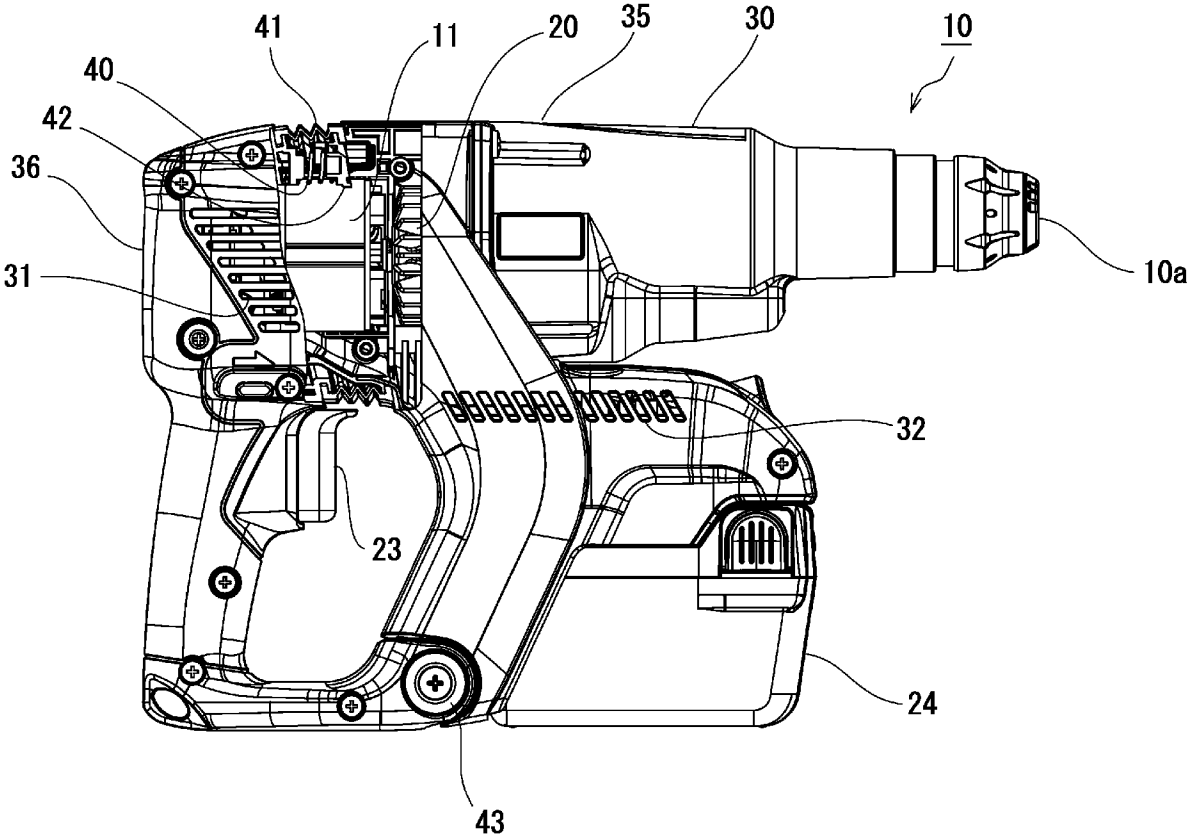
FIG. 1 is a side view illustrating an impact tool with an internal structure being partially exposed.
Figure 2:
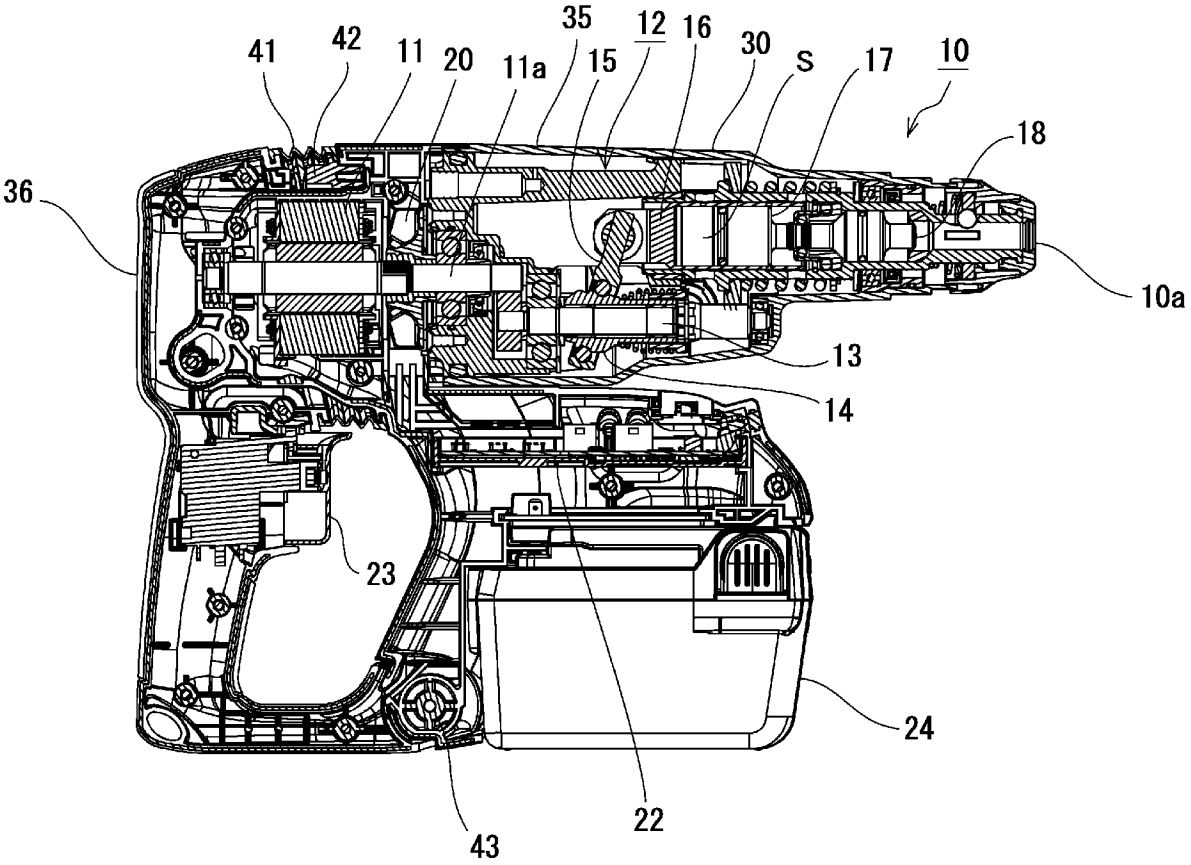
FIG. 2 is a sectional view illustrating the impact tool.

As illustrated in FIGS. 1 and 2, the impact tool 10 includes a motor 11, a mechanism part 12, a fan 20, a control board 22, a trigger 23, a battery 24, and a housing 30.

The motor 11 is held in the housing 30 in a rear of the impact tool 10. An output shaft 11*a* of the motor 11 meshes with an intermediate shaft 13 of the mechanism part 12 that will be described later. The output shaft 11*a* meshes with the intermediate shaft 13 to transmit the rotating force of the motor 11 to the mechanism part 12.

The mechanism part 12 operates using the motor 11 as driving force, and is arranged in front of the motor 11 to be held in the housing 30. This mechanism part 12 operates using the motor 11 as the driving force, and strikes the tool bit. Although a detailed description will be omitted herein, this mechanism part 12 has a rotating and hitting mode where the tool bit performs the hitting operation while rotating, a hitting mode where the tool bit performs only the hitting operation without rotating, and a rotating mode where the tool bit only rotates without performing the hitting operation, and is configured to use by switching the modes.

As illustrated in FIG. 2, this mechanism part 12 includes the intermediate shaft 13 meshing with the output shaft 11*a* of the motor 11, a rotary body 14 attached to an outer circumference of the intermediate shaft 13, a swing rod 15 attached to the rotary body 14 and extending in a circumferential direction, a piston 16 connected to a leading end portion of the swing rod 15, a striker 17 operating with reciprocating movement in a front and rear direction of the piston 16, and an intermediate member 18 transmitting the striking force of the striker 17 to the tool bit.

The intermediate shaft 13 meshes with the output shaft 11*a* of the motor 11, and rotates along with the output shaft 11*a* when the motor 11 rotates.

The rotary body 14 is fixed to the intermediate shaft 13, and rotates integrally with the intermediate shaft 13. A circumferential groove is formed in an outer circumference of the rotary body 14 to engage with a bearing of the swing rod 15 that will be described later. The circumferential groove is inclined relative to an axis of the intermediate shaft 13. Therefore, when the rotary body 14 rotates, the inclination of the bearing is changed and the swing rod 15 swings.

The swing rod 15 is rotatably attached to the rotary body 14 through the bearing. This swing rod 15 is supported on the impact tool 10 to swing in a front and back direction. As described above, as the rotary body 14 rotates, the rotation thereof is changed into the swinging motion of the swing rod 15 in the front and back direction.

The piston 16 is a cylindrical piston that reciprocates forward and backward in conjunction with the swinging motion of the swing rod 15. When this piston 16 moves forward, air in an air chamber S defined in front of the piston 16 is compressed, and the striking force is transmitted to the striker 17 that will be described later, through a change (air spring) in air pressure of the air chamber S.

The striker 17 is disposed in the impact tool 10 to be slidable forward and backward. As described above, this striker 17 performs a striking movement in conjunction with the change in air pressure of the air chamber S, which is caused by the reciprocating movement in the front and back direction of the piston 16.

The intermediate member 18 is arranged between the striker 17 and the tool bit, and serves to transmit the striking force generated when the striker 17 collides with the intermediate member from the rear.

This mechanism part 12 operates as follows. First, as the motor 11 rotates, the rotating force of the motor 11 is transmitted to the intermediate shaft 13. As the intermediate shaft 13 rotates, the rotary body 14 rotates. By the rotation of the rotary body 14, the swing rod 15 swings in the front and back direction. When the swing rod 15 swings, the piston 16 reciprocates and the air pressure of the air chamber S in the rear of the striker 17 is changed. As the air pressure of the air chamber S is changed, the striker 17 executes a striking movement and imparts the striking force to the intermediate member 18. Then, the striking force is transmitted to the tool bit through the intermediate member 18, and performs the drilling or crushing operation using the tool bit that is pushed against the object such as concrete or stone.

The fan 20 blows air for cooling the motor 11 or the control board 22 into the housing 30. According to the present embodiment, the fan is arranged between the motor 11 and the mechanism part 12. This fan 20 is connected to the output shaft 11*a* of the motor 11, and rotates simultaneously when the motor 11 rotates. Thus, outside air is sucked from an intake window 31 that is open to a side of the housing 30, and the sucked air is discharged to an outside from an air outlet 32 that is open to a side of the housing 30.

The control board 22 serves to control the operation of the motor 11. The control board 22 according to the present embodiment is placed below the mechanism part 12 or above the battery 24 to be parallel to the axial direction D1 of the tool bit (which is the strike direction of the impact tool).

The trigger 23 is a manipulation part for operating the motor 11, and is disposed exactly at a position of a forefinger when a user holds the grip of the impact tool 10. The trigger 23 is pulled to cause the motor 11 to start to rotate.

The battery 24 is a secondary battery that supplies power to the motor 11 or the control board 22 and becomes a power source of the mechanism part 12. This battery 24 is a detachable-type battery 24 that may be attached to the housing 30, and is configured to be removed from the housing 30 and thereby be charged.

The housing 30 holds the motor 11 or the mechanism part 12, and covers an entirety of the impact tool 10. The housing 30 according to the present embodiment includes a main-body housing 35 that holds the mechanism part 12, and a grip housing 36 that is continuously coupled to a rear portion of the main-body housing 35.

Figure 3:
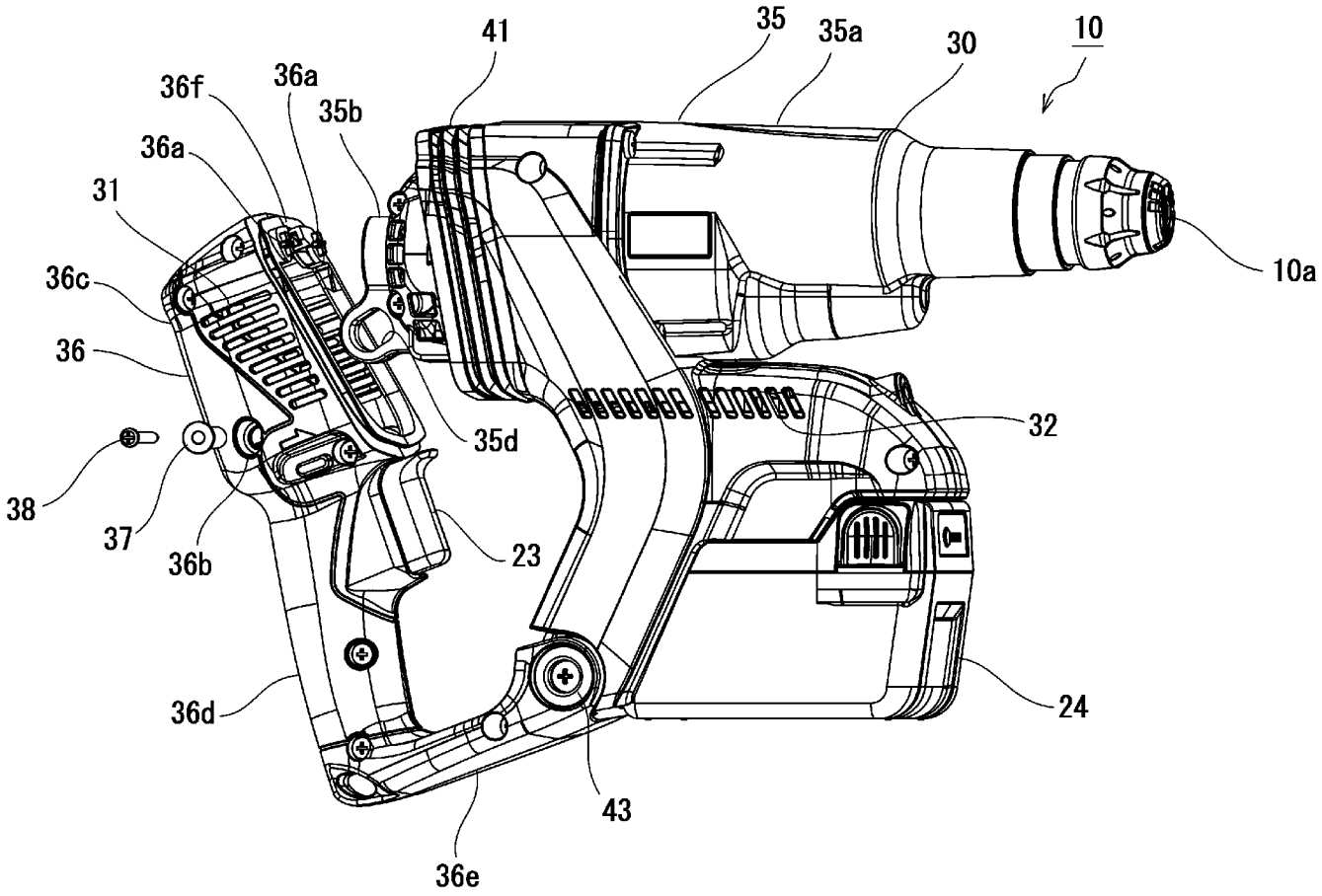
FIG. 3 is an external view of the impact tool illustrating the state of attaching a grip-housing.
Figure 4:
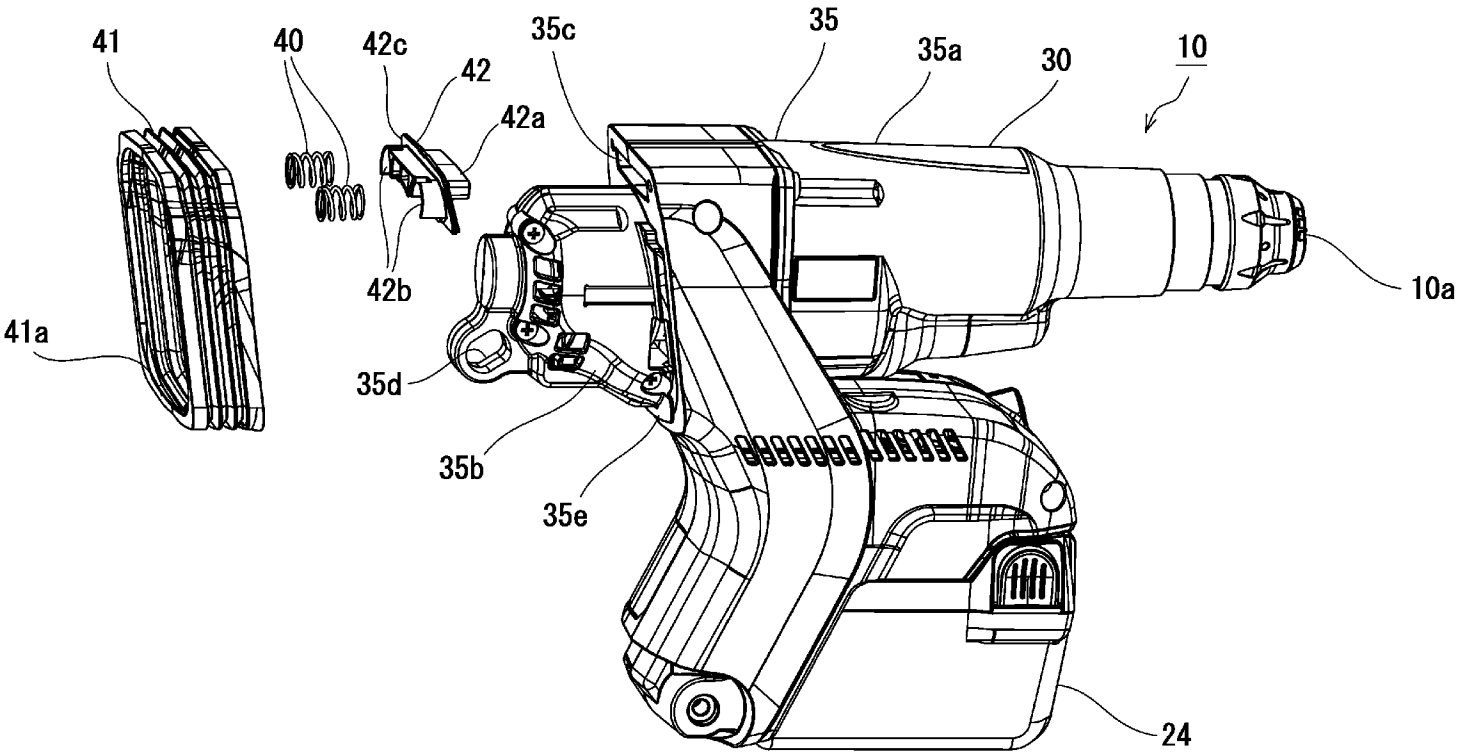
FIG. 4 is an exploded view of the impact tool illustrating the attaching direction of an elastic member.

As illustrated in FIGS. 3 and 4, the main-body housing 35 includes a mechanism receiving part 35*a* that receives the mechanism part 12, a motor receiving part 35*b* that is continuously installed behind the mechanism receiving part 35*a* to receive the motor 11, an engaging part 35*c* that is formed on a surface facing the grip housing 36, a pin engaging part 35*d* that protrudes from an end portion of the motor receiving part 35*b*, and a plate-shaped locking projection 35*e* that is formed on a root of the motor receiving part 35*b*.

The mechanism receiving part 35*a* is a long cylindrical part that partially receives the mechanism part 12, the fan 20, and a front end portion of the motor 11. An opening is formed in the front end portion of the mechanism receiving part 35*a* to constitute the tool bit attaching part 10*a*.

The motor receiving part 35*b* protrudes from a rear end surface of the mechanism receiving part 35*a*, and is formed to cover the motor 11 from a rear portion thereof. An inside of the motor receiving part 35*b* communicates with an inside of the mechanism receiving part 35*a*, and the motor receiving part 35*b* and the mechanism receiving part 35*a* integrally define a receiving space.

The engaging part 35*c* is a concave part that is formed in a rear end surface of the mechanism receiving part 35*a*, and is used to attach a spring holding member 42 that will be described later thereto.

The pin engaging part 35*d* is used to attach the grip housing 36 to the main-body housing 35. The pin engaging part 35*d* according to the present embodiment is formed on the rear portion of the motor receiving part 35*b* to protrude in a ring shape, and has an elongate hole to slidably support a pin 37 that will be described later.

The locking projection 35*e* is a plate-shaped protrusion to which a joint cover 41 to be described later is attached. According to the present embodiment, the locking projection 35*e* is formed only on a side surface of the root of the motor receiving part 35*b*. In detail, when viewed from the spring holding member 42 that will be described later, the locking projection 35*e* is formed only on an opposite side of the spring holding member across the motor receiving part 35*b*.

As illustrated in FIGS. 3 and 4, the grip housing 36 includes a motor surrounding part 36*c* attached to cover the motor receiving part 35*b* of the main-body housing 35, a pole part 36*d* extending downward from the motor surrounding part 36*c*, a connecting part 36*e* protruding forward from a lower end portion of the pole part 36*d*, a spring support part 36*a* formed on a surface facing the main-body housing 35, a pin hole 36*b* penetrated through a side surface of the motor surrounding part 36*c*, and a flange part 36*f* formed around a front end portion of the motor surrounding part 36*c*.

The motor surrounding part 36*c* is a part having the shape of a basket that is open at a front thereof. This motor surrounding part 36*c* is attached to cover the motor receiving part 35*b* of the main-body housing 35 from the rear.

The pole part 36*d* is a part constituting the grip of the impact tool 10. The trigger 23 is disposed on the pole part 36*d*.

The connecting part 36*e* protrudes forward from the lower end portion of the pole part 36*d* at approximately right angles. The front end portion of the connecting part 36*e* is rotatably connected to the main-body housing 35 through a rotary joint 43.

The spring support part 36*a* is a convex part that is formed on an opening edge of the motor surrounding part 36*c*, and is used for mounting of an end portion of an elastic member 40.

The pin hole 36*b* is used to attach the grip housing 36 to the main-body housing 35. The pin 37 passing through the pin hole 36*b* engages with the above-described pin engaging part 35*d*, so that the grip housing 36 is movably coupled to the main-body housing 35.

The flange part 36*f* is the plate-shaped protrusion to which the joint cover 41 to be described later is attached.

The above-described main-body housing 35 and grip housing 36 are connected as follows.

First, one end portion (around the motor surrounding part 36*c*) of the grip housing 36 is movably connected to the main-body housing 35 through the elastic member 40. Specifically, as illustrated in FIG. 4, the elastic member 40, the joint cover 41, and the spring holding member 42 are arranged between the main-body housing 35 and the grip housing 36. The main-body housing 35 and the grip housing 36 are connected to each other through these members.

The elastic member 40 is a compression spring that is compressed and placed between the main-body housing 35 and the grip housing 36. This elastic member 40 is elastically deformed when the main-body housing 35 moves relative to the grip housing 36, thus serving to absorb vibration. According to the exemplary embodiment, two elastic members 40 are placed on left and right sides above the motor receiving part 35*b*. As such, the elastic members 40 of even numbers are arranged to form a bilateral symmetry structure, thus suppressing side-to-side looseness.

Assuming that a spring constant is K, an impact frequency of the impact tool 10 is f, and a mass of the grip is m, the spring constant of the elastic member 40 is set to satisfy the following equation: "K<m (2πf)^2". By setting the spring constant as such, it is possible to obtain stable vibration controlling effects in consideration of vibration damping characteristics.

A joint cover 41 is a bellows-type cylindrical member, and is formed of synthetic resin, rubber or the like, which are elastic deformable. This joint cover 41 covers a junction between the main-body housing 35 and the grip housing 36, thus preventing dust or the like from entering the junction and preventing the junction from getting dirty. The relative movement between the main-body housing 35 and the grip housing 36 serves to absorb vibration, together with the elastic member 40. This joint cover 41 is attached to the main-body housing 35 and the grip housing 36 using locking grooves 41*a* formed on both end portions thereof. That is, the locking groove 41*a* on the front end portion engages with the locking projection 35*e* of the main-body housing 35 and a hook part 42*c* (described later) of the spring holding member 42. The locking groove 41*a* on the rear end portion engages with the flange part 36*f* of the grip housing 36.

The spring holding member 42 is a member that is used to attach the elastic member 40. As illustrated in FIG. 4, this spring holding member 42 includes a convex part 42*a* formed on a surface facing the main-body housing 35, a spring holding part 42*b* formed on a surface facing the grip housing 36, and a flange-shaped hook part 42*c* formed on an outer circumference between the convex part 42*a* and the spring holding part 42*b*.

The convex part 42*a* is a part that is inserted into the engaging part 35*c* of the main-body housing 35. By inserting the convex part 42*a* into the engaging part 35*c* of the main-body housing 35, the spring holding member 42 is fixed to the main-body housing 35.

The spring holding part 42*b* is a concave part for supporting end portions of the elastic member 40. One end portion of the elastic member 40 is supported on the spring holding part 42*b* and the other end portion of the elastic member 40 is supported on the spring support part 36*a* of the grip housing 36, so that a predetermined elastic force acts between the spring holding member 42 (main-body housing 35) and the grip housing 36 in a direction where they are separated from each other.

As such, the spring holding member 42 is used to attach the elastic member 40, thus realizing the simplification of a mold and the size reduction of a product, in addition to stabilizing the spring stroke of the elastic member 40. That is, the spring holding member 42 is formed as a member independent from the housing 30, thus minimizing an influence on the mold, and then allowing the shape of the spring holding member 42 to be freely established. Therefore, a guide shape (the spring holding part 42*b* that is deeply formed) is formed to stabilize the spring stroke of the elastic member 40, thus stabilizing the spring stroke, and the hook part 42*c* is formed to attach the joint cover 41, thus realizing the size reduction of the product.

Figure 5:
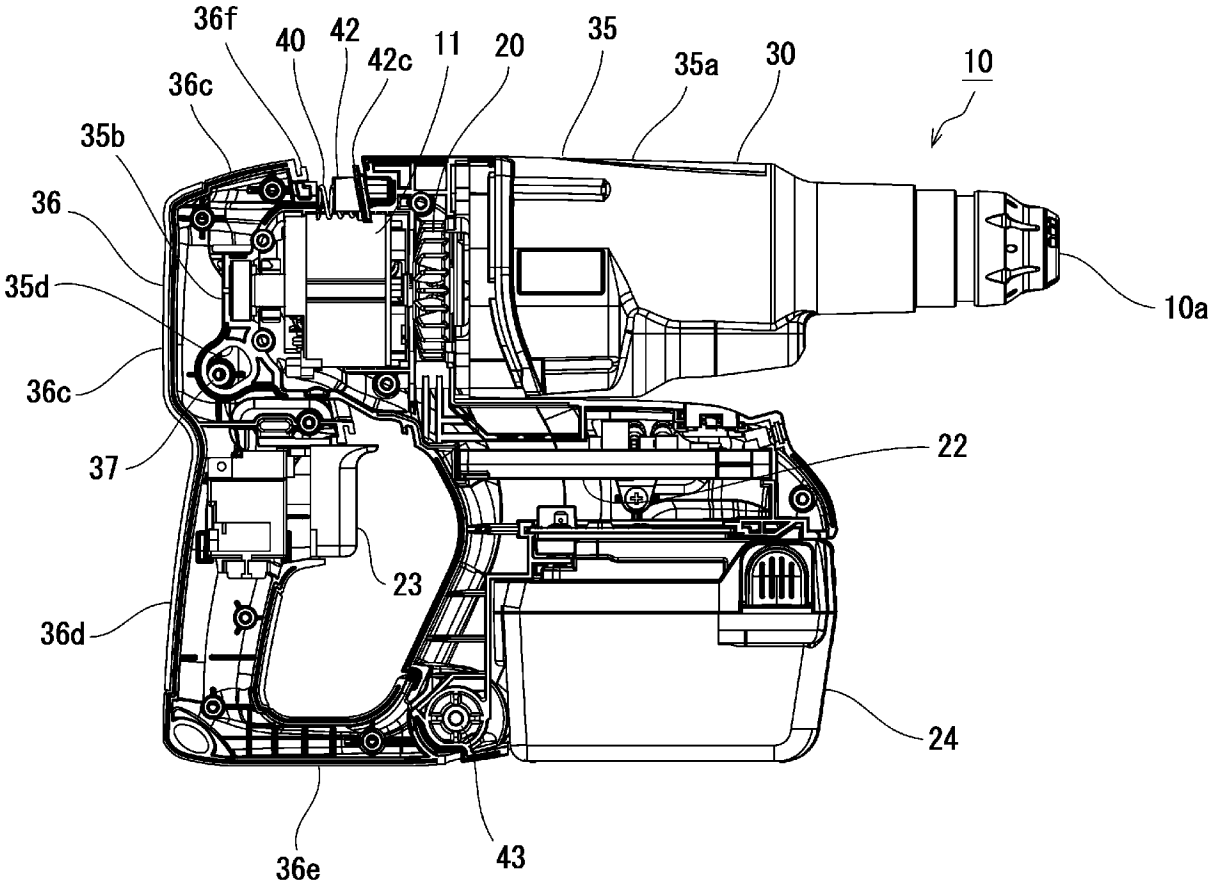
FIG. 5 is a view illustrating an internal structure of the impact tool.

Meanwhile, since the main-body housing 35 and the grip housing 36 themselves are subjected to the biasing force of the elastic member 40 and thereby are moved out of a given range, the moving range thereof is limited by the pin 37 made of a steel material. Specifically, as illustrated in FIG. 3, the pin 37 passing through the pin hole 36*b* of the grip housing 36 is inserted into a hole of the pin engaging part 35*d* of the main-body housing 35. This pin 37 is fastened not to be removed from the pin hole 36*b* by a bolt 38 and a nut (not illustrated). Thereby, as illustrated in FIG. 5, the pin 37 engages with the pin engaging part 35*d* to withstand the biasing force of the elastic member 40. In other words, the pin 37 engages with the pin engaging part 35*d*, thus restricting a movement where the main-body housing 35 is separated from the grip housing 36. On the other hand, when the main-body housing 35 and the grip housing 36 are moved in a direction where they come near to each other, the pin 37 moves along the pin engaging part 35*d*, so that the movement is not obstructed by the pin 37 and the pin engaging part 35*d*. Therefore, the main-body housing 35 may approach the grip housing 36 until the grip housing 36 comes into contact with the spring holding member 42.

As described above, the pin 37 of the steel material restricts the separation between the main-body housing 35 and the grip housing 36, thus ensuring strength sufficient to bear a load. For example, by conveying the tool with the leading end portion of the tool facing downwards, it is possible to restrict the separation using the pin 37 of the steel material even when the main-body housing 35 is intended to be separated from the grip housing 36 by the weight of the tool. Further, when the tool bit is drawn out from a hole after the drilling work has been completed, the tool bit is pulled while interfering with the hole. Even when the main-body housing 35 is separated from the grip housing 36, it is possible to restrict the separation using the pin 37 of the steel material.

When the main-body housing 35 and the grip housing 36 are mounted by connecting the main-body housing 35 with the grip housing 36 using the pin 37, left and right dividing pieces of the grip housing 36 are simultaneously coupled with each other, and thus mounting ability thereof is improved.

As described above, the hook part 42*c* is the plate-shaped protrusion for hooking and attaching the joint cover 41.

Meanwhile, the other end portion (around the connecting part 36*e*) of the grip housing 36 is rotatably connected to the main-body housing 35 through the rotary joint 43.

Figure 6:
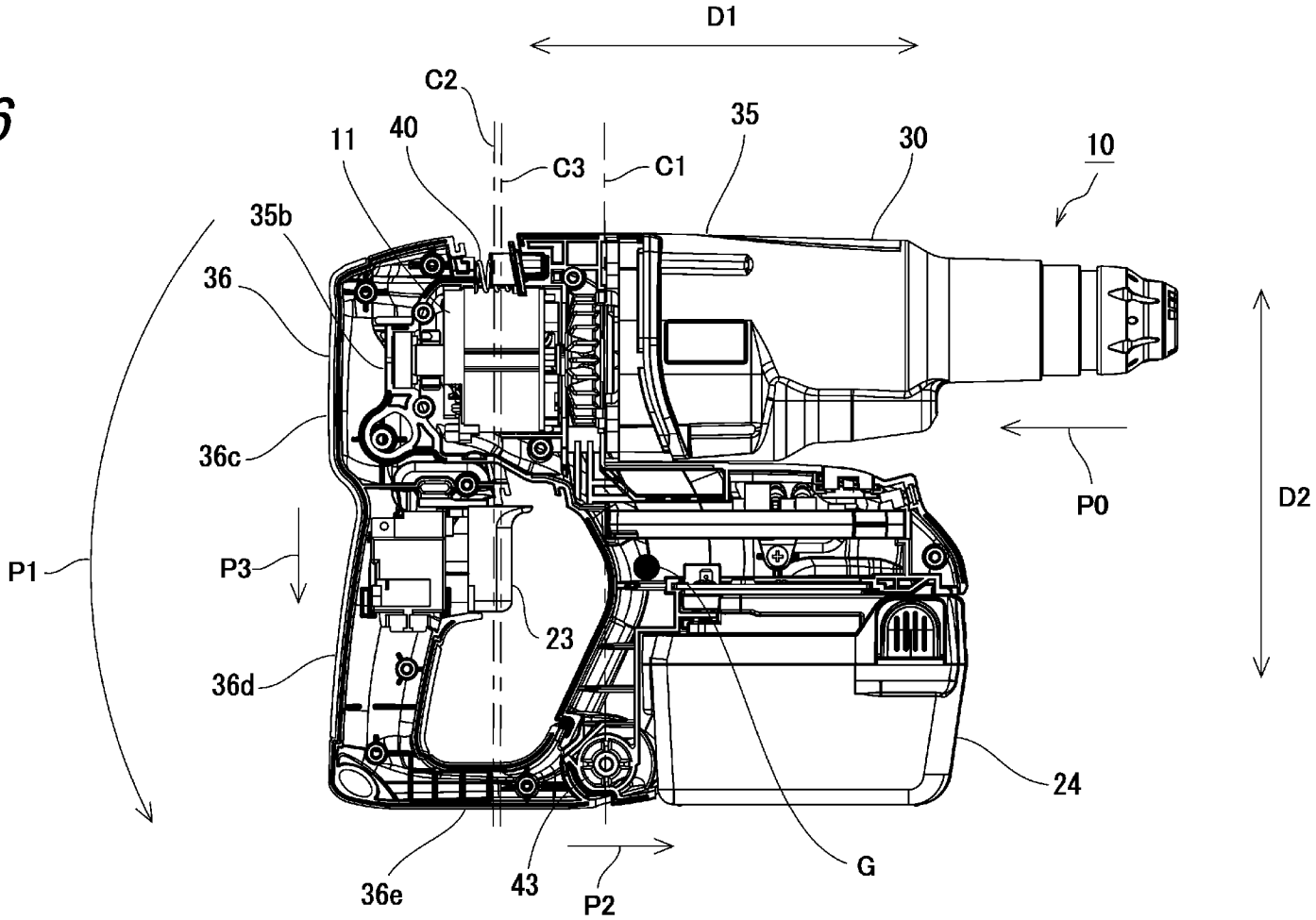
FIG. 6 is a view illustrating a force that acts on the impact tool when a striking operation is performed.

As illustrated in FIG. 6, the center of the rotary joint 43 is disposed nearer to the leading end side of the tool bit (which is the leading side of the impact tool) in comparison to the center of the elastic member 40, when viewed from the axial direction D1 of the tool bit (which is the strike direction of the impact tool). In other words, when comparing a central line C1 of the rotary joint 43 when viewed from the axial direction D1 of the tool bit (which is the strike direction of the impact tool) with a central line C2 of the elastic member 40 when viewed from the axial direction D1 of the tool bit (which is the strike direction of the impact tool), the former is disposed nearer to the leading end side of the tool bit (which is the leading side of the impact tool).

Further, the center of the rotary joint 43 is disposed nearer to the leading end side of the tool bit (which is the leading side of the impact tool) in comparison to the center of the motor 11 (the center of a stator of the motor 11), when viewed from the axial direction D1 of the tool bit (which is the strike direction of the impact tool). In other words, when comparing a central line C1 of the rotary joint 43 when viewed from the axial direction D1 of the tool bit (which is the strike direction of the impact tool) with a central line C3 of the motor 11 when viewed from the axial direction D1 of the tool bit (which is the strike direction of the impact tool), the former is disposed nearer to the leading end side of the tool bit (which is the leading side of the impact tool). In addition, the central line C1 of the rotary joint 43 when viewed from the axial direction D1 of the tool bit (which is the strike direction of the impact tool) is disposed nearer to the leading end side of the tool bit (which is the leading side of the impact tool) in comparison to the front end portion of the motor 11 when viewed from the axial direction D1 of the tool bit (which is the strike direction of the impact tool).

As such, the center of the rotary joint 43 is arranged at a position close to the mechanism part 12, thus causing the rotary joint 43 to be located near to the center of gravity of the impact tool 10. Such a configuration makes it difficult to act force in the direction D2 (the extending direction of the grip) perpendicular to the axial direction of the tool bit (which is the strike direction of the impact tool) on the rotary joint 43 during the hitting operation, thus making it difficult to occur a vibration component that may not be absorbed by the elastic member 40 and enhancing the effect of reducing the impact force.

Specifically, as illustrated in FIG. 6, if the tool bit is pushed back by the reaction to the hitting operation (see reference numeral P0), the impact tool 10 is intended to rotate about the center of gravity G (see reference numeral P1). Even when force for rotating the impact tool 10 is exerted, the center of the rotary joint 43 is located near to the center of gravity G of the impact tool 10, so that force in the axial direction D1 of the tool bit (which is the strike direction of the impact tool) principally acts on the rotary joint 43 (see reference numeral P2). In other words, it is difficult for force in the extending direction D2 of the grip to act on the rotary joint 43. Therefore, since only the vibration component that may be sufficiently absorbed by the elastic member 40 acts on the rotary joint 43, it is possible to maximally exhibit the vibration absorbing effect by the elastic member 40.

Further, according to the present exemplary embodiment, the motor receiving part 35*b* of the main-body housing 35 protrudes from the rear end surface of the mechanism receiving part 35*a*, and the motor receiving part 35*b* is covered by the motor surrounding part 36*c* of the grip housing 36. Such a configuration allows the grip housing 36 to overlap the motor 11, and allows the center of gravity of a machine to be located as rearwards as possible. In addition, since the rotary joint 43 is formed on the leading end portion of the connecting part 36*e* of the grip housing 36, the rotary joint 43 is shaped to protrude forwards. Therefore, it is possible to locate the center of the rotary joint 43 as forwards as possible. As such, the center of gravity of the machine is located at the rear position and the rotary joint 43 is located at the front position, thus allowing the rotary joint 43 to be located near to the center of gravity of the impact tool 10.

Furthermore, according to the present exemplary embodiment, as illustrated in FIG. 6, the trigger 23 is located to overlap the center of gravity G of the impact tool 10 when projected in the axial direction D1 of the tool bit (which is the strike direction of the impact tool). Such a location makes it difficult to act vibration in the axial direction D1 of the tool bit (which is the strike direction of the impact tool) on a worker's hand holding the trigger 23, even when force for rotating the impact tool 10 is exerted. That is, if the hitting operation is performed, the impact tool 10 tends to rotate about the center of gravity G, but the trigger 23 is located to overlap the center of gravity G of the impact tool 10 when viewed in the axial direction D1 of the tool bit (which is the strike direction of the impact tool), so that a force component in the extending direction D2 of the grip mainly acts on the surroundings of the trigger 23 (see reference numeral P3). In other words, it is difficult for force in the axial direction D1 of the tool bit (which is the strike direction of the impact tool) to act on the surroundings of the trigger 23. Therefore, it is possible to further alleviate the burden imposed on a worker's arm holding the grip, in addition to achieving the vibration absorbing effect. Moreover, when the axis of the tool bit is placed in a perpendicular direction on an upper punch or the like, no moment acts on a holding part of the grip, thus alleviating a burden during the maintenance of the impact tool 10.

What is claimed is:

1. An impact tool comprising:

a mechanism part that strikes a tool bit, wherein the tool bit is on a front end of the impact tool;

a motor located behind the mechanism part and which operates the mechanism part;

a main-body housing that holds the mechanism part therein;

a grip housing that is located at a rear portion of the main-body housing, the grip housing including a first end portion and a second end portion;

the first end portion of the grip housing is displaceably connected to the main-body housing through an elastic member, and the second end portion of the grip housing is rotatably connected to the main-body housing through a rotary joint;

a center of the rotary joint is located closer to the front end of the impact tool than a center of the elastic member with respect to a strike direction of the impact tool, with respect to the strike direction, a center of gravity of the impact tool is located closer to the front end of the impact tool than a center of the motor which operates the mechanism part;

in a side view in a direction perpendicular to the strike direction and in which the mechanism part is in an upper portion of the impact tool and a bottom of the grip housing is at a bottom portion of the tool, the center of gravity of the impact tool is located vertically between the elastic member and the rotary joint, with the elastic member vertically higher than the center of gravity of the impact tool and the rotary joint vertically lower than the center of gravity of the impact tool; and a trigger, operating the mechanism part, said trigger having a contact surface, and a front of the contact surface of the trigger is closer to the front end of the tool than the center of the motor.

2. The impact tool according to claim 1 wherein the trigger is located to overlap with the center of gravity of the impact tool when projected in the strike direction of the impact tool.

3. The impact tool according to claim 1, further comprising:

a spring holding member that supports the elastic member between the main-body housing and the grip housing.

4. The impact tool according to claim 1, further comprising:

a pin that is configured to pass through a hole of a pin engaging part of the main-body housing so as to be supported by the grip housing.

5. The impact tool according to claim 1, wherein with respect to the strike direction the center of the motor is closer to the front end of the impact tool than the center of the elastic member.

6. An impact tool comprising:

a mechanism part that strikes a tool bit, wherein the tool bit is on a front end of the impact tool;

a motor located behind the mechanism part and which operates the mechanism part;

a main-body housing that holds the mechanism part therein;

a grip housing that is located at a rear portion of the main-body housing, the grip housing including a first end portion and a second end portion;

the first end portion of the grip housing is displaceably connected to the main-body housing through an elastic member, and the second end portion of the grip housing is rotatably connected to the main-body housing through a rotary joint;

a center of the rotary joint is located closer to the front end of the impact tool than a center of the motor which operates the mechanism part with respect to a strike direction of the impact tool;

with respect to the strike direction, a center of gravity of the impact tool is located closer to the front end of the impact tool than the center of the motor which operates the mechanism part;

in a side view in a direction perpendicular to the strike direction and in which the mechanism part is in an upper portion of the impact tool and a bottom of the grip housing is at a bottom portion of the tool, the center of gravity of the impact tool is located vertically between the elastic member and the rotary joint, with the elastic member vertically higher than the center of gravity of the impact tool and the rotary joint vertically lower than the center of gravity of the impact tool; and a trigger, operating the mechanism part, said trigger having a contact surface, and a front of the contact surface of the trigger is closer to the front end of the tool than the center of the motor.

7. The impact tool according to claim 6, wherein the trigger is located to overlap with the center of gravity of the impact tool when projected in the strike direction of the impact tool.

8. The impact tool according to claim 6, further comprising:

a spring holding member that supports the elastic member between the main-body housing and the grip housing.

9. The impact tool according to claim 6, further comprising:

a pin that is configured to pass through a hole of a pin engaging part of the main-body housing so as to be supported by the grip housing.

10. The impact tool according to claim 6, wherein the center of the rotary joint is located closer to the front end of the impact tool than a center of the elastic member with respect to the strike direction of the impact tool.

11. The impact tool according to claim 6, wherein with respect to the strike direction the center of the motor is closer to the front end of the impact tool than a center of the elastic member.

* * * * *